US007215079B2

(12) United States Patent
Park et al.

(10) Patent No.: US 7,215,079 B2
(45) Date of Patent: May 8, 2007

(54) FLAT FLUORESCENT LAMP REQUIRING LOW DISCHARGE INITIATING VOLTAGE AND BACKLIGHT UNIT HAVING UNIFORM BRIGHTNESS

(75) Inventors: Deuk Il Park, Suwon-si (KR); Choong Yop Rhew, Suwon-si (KR)

(73) Assignee: LS Tech Co., Ltd., Hwasung-si (KR)

( * ) Notice: Subject to any disclaimer, the term of this patent is extended or adjusted under 35 U.S.C. 154(b) by 242 days.

(21) Appl. No.: 10/813,188

(22) Filed: Mar. 29, 2004

(65) Prior Publication Data

US 2005/0184666 A1 Aug. 25, 2005

(30) Foreign Application Priority Data

Feb. 20, 2004 (KR) ..... 10-2004-0011356

(51) Int. Cl.
*H01J 61/06* (2006.01)

(52) U.S. Cl. ..... 313/607; 313/582; 313/587; 313/581; 313/594

(58) Field of Classification Search ..... 313/607, 313/581, 594, 234, 582, 583, 584, 585, 586, 313/587
See application file for complete search history.

(56) References Cited

U.S. PATENT DOCUMENTS 5,220,249 A * 6/1993 Tsukada ..... 315/246
5,319,282 A * 6/1994 Winsor ..... 315/169.4
5,463,274 A * 10/1995 Winsor ..... 313/493
6,034,470 A * 3/2000 Vollkommer et al. ..... 313/485
6,218,776 B1 * 4/2001 Cull et al. ..... 313/493
6,246,171 B1 * 6/2001 Vollkommer et al. ..... 313/586
2002/0030437 A1 * 3/2002 Shimizu et al. ..... 313/495
2002/0063523 A1 * 5/2002 Amatsuchi et al. ..... 313/582

FOREIGN PATENT DOCUMENTS

JP 2000-0082441 3/2000
KR 2001-0079377 8/2001

* cited by examiner

*Primary Examiner*—Joseph Williams
*Assistant Examiner*—Hana Asmat Sanei
(74) *Attorney, Agent, or Firm*—Schmeiser, Olsen & Watts LLP

(57) ABSTRACT

A flat fluorescent lamp has a uniform screen brightness even with a low discharge initiating voltage. A backlight unit using the flat fluorescent lamp is provided. The flat fluorescent lamp includes a front substrate, a back substrate having a continuous serpentine type discharge channel defined by a plurality of partitions extending alternately from both side ends of the back substrate. An inverter and a pair of electrodes provided on one of the front and the back substrates apply power to the electrodes. Each of the electrodes includes discharge electrodes mounted in strip configurations and a plurality of subsidiary electrodes that are mounted to extend perpendicularly from the discharge electrodes and to correspond to positions of the partitions. The plurality of subsidiary electrodes are alternately connected to inner edges of both the discharge electrodes so that neighboring subsidiary electrodes have different polarities.

8 Claims, 6 Drawing Sheets

FLAT FLUORESCENT LAMP REQUIRING LOW DISCHARGE INITIATING VOLTAGE AND BACKLIGHT UNIT HAVING UNIFORM BRIGHTNESS

BACKGROUND OF THE INVENTION

1. Field of the Invention

The present invention relates to liquid crystal displays. More specifically, the present invention is directed to a flat fluorescent lamp, characterized by inducing a discharge even at a low discharge initiating voltage, minimizing a non-luminescent region, and maintaining an optimal luminance uniformity, whereby the flat fluorescent lamp has a uniform screen brightness; and a backlight unit using the same.

2. Description of the Related Art

In general, a flat-panel display is classified into a light-emitting type, such as CRT (Cathode Ray Tube), FED (Field Emission Display), PDP (Plasma Display Panel) and organic EL (Electro Luminescence), and a light-receiving type, for example, LCD (Liquid Crystal Display). Of them, the liquid crystal display has no light-emitting structure, and cannot display an image unless light is externally irradiated. Hence, an additional light source, for example, a backlight unit, should be employed to display the image.

Such a backlight unit utilizes a manner of fabricating a planar light source by converting light irradiated from CCFL (Cold Cathode Fluorescent Lamp) through a light plate, or by disposing a plurality of CCFLs onto a rear surface of a liquid crystal panel, or by placing a discharge gas and a fluorescent material between flat glass plates to cause a discharge.

In particular, a flat fluorescent lamp, which is the manner of fabricating a planar light source by placing a discharge gas and a fluorescent material between flat glass plates to cause a discharge, is composed of a discharge electrode structure attached to a front substrate or a back substrate while the discharge gas including xenon (Xe) and neon (Ne) is filled in a discharge channel between the front and back substrates coated with the fluorescent material as the two flat glass plates.

Upon application of power to the discharge electrode of the above flat fluorescent lamp, while the fluorescent layer is excited by ultraviolet light caused by a gas discharge between the discharge electrodes and then converted to a stable state, visible light is generated (surface light emission), thereby realizing the image of the liquid crystal display.

However, the conventional flat fluorescent lamp, as mentioned above, is disadvantageous in terms of a short electrode spacing, and a low ultraviolet light emission efficiency of the discharge gas. On this account, a conversion efficiency of the ultraviolet light to the visible light amounts to 30 lm/W at the most. Hence, to increase the above conversion efficiency, there is required a high driving power. So high a driving power leads to an increased power consumption, whereby power loss is caused. After all, the conventional flat fluorescent lamp suffers from the generation of tremendous heat.

Proposed to increase a light efficiency, a flat fluorescent lamp includes a discharge channel having a serpentine shape that is formed between a front substrate and a back substrate as two flat glass plates, and an electrode disposed at each of a starting point and an ending point of the serpentine type discharge channel, which has reference to FIG. 1. Such a flat fluorescent lamp, having one discharge channel, allows a large quantity of current to flow in the relatively long discharge channel, thus enhancing the light efficiency.

However, the above flat fluorescent lamp is disadvantageous in that the long discharge channel requires a high discharge initiating voltage, and then a high driving voltage. After all, a current leakage increases. Further, although there is necessary a flat fluorescent lamp having a drastically lengthened serpentine channel according to the fabrication of large-sized LCDs and backlight units in recent years, it is impossible to commercially manufacture such a flat fluorescent lamp.

To solve the problems, Korean Patent Laid-open Publication No. 2001-0079377 discloses a flat fluorescent lamp and a fabrication method thereof. The disclosed fabrication method of the flat fluorescent lamp includes steps of heating a flat glass plate to predetermined molding temperatures, molding the heated flat glass plate by use of a mold processed to have a plurality of discharge channels defined by partitions and communicated with each other through discharge passages, to prepare a molded flat glass plate having discharge channels, removing the molded glass plate from the mold, slowly cooling the molded glass plate, coating a fluorescent material to the insides of the discharge channels of the molded glass plate, followed by a burning process, attaching the glass plate to a front cover through a sealing frit, removing air from the insides of the discharge channels of the glass plate, introducing a discharge gas into the discharge channels, closing exhaust ports of the discharge channels, and mounting an electrode to apply a high frequency power to the discharge channels. The flat fluorescent lamp fabricated like this has an electrode structure of inner electrodes disposed to both ends of the discharge channels or strip-shaped outer electrodes disposed at both lateral surfaces of the discharge channels. However, the flat fluorescent lamp having the above discharge electrode structure suffers from crosstalk between discharge channels, which causes a strong discharge in a specific discharge channel among the discharge channels or a very unstable plasma discharge, upon the discharge by application of the power. This causes differences between strengths of electric field of the discharge channels, resulting in a non-uniform luminance. Eventually, the flat fluorescent lamp has a non-uniform screen brightness.

This is because large quantities of discharge currents gather in the specific discharge channel where the discharge relatively easily occurs while discharge charges are freely transferred to the neighboring discharge channels through the discharge passages.

SUMMARY OF THE INVENTION

Accordingly, an object of the present invention is to alleviate the problems encountered in the related art and to provide a flat fluorescent lamp, which is advantageous in terms of generating a discharge even at a low driving voltage (discharge initiating voltage), minimizing a non-luminescent region, and maintaining an optimal luminance uniformity, thus realizing a uniform screen brightness thereof.

Another object of the present invention is to provide a backlight unit using the flat fluorescent lamp.

Disclosed herein is a flat fluorescent lamp having a uniform screen brightness by inducing a discharge even at a low discharge initiating voltage, minimizing a non-luminescent region, and maintaining an optimal luminance uniformity. Further, a backlight unit using the flat fluorescent lamp is provided. The flat fluorescent lamp includes a front substrate, a back substrate having a continuous serpentine type discharge channel defined by a plurality of partitions which are extended from both side ends of the back substrate and alternately disposed, a pair of electrodes provided on an outer surface of any one of the front substrate and the back substrate, and an inverter to apply power to the electrodes. Each of the electrodes includes discharge electrodes mounted in strip shapes along both side ends of the outer surface of any one of the front substrate and the back substrate. A plurality of subsidiary electrodes are mounted on the outer surface of any one of the front substrate and the back substrate to correspond to positions of the partitions. The plurality of subsidiary electrodes are disposed to be perpendicular to the discharge electrodes. The plurality of subsidiary electrodes are alternately connected to inner edges of both the discharge electrodes so that neighboring subsidiary electrodes have different polarities.

To achieve the above objects, there is provided a flat fluorescent lamp according to a first embodiment of the present invention, including a front substrate, a back substrate having a continuous serpentine type discharge channel defined by a plurality of partitions, which are extended from both side ends of the back substrate and alternately disposed, a pair of electrodes provided on an outer surface of any one of the front substrate and the back substrate, and an inverter to apply power to the electrodes, wherein each of the electrodes includes a discharge electrode and a plurality of subsidiary electrodes, in which the discharge electrodes are mounted in strip shapes along both side ends of the outer surface of the any one of the front substrate and the back substrate, and the plurality of subsidiary electrodes are mounted on the outer surface of the any one of the front substrate and the back substrate to correspond to positions of the partitions, and are disposed to be perpendicular to the discharge electrodes, the plurality of subsidiary electrodes being alternately connected to inner edges of both the discharge electrodes so that neighboring subsidiary electrodes have different polarities.

According to a second embodiment of the present invention, a flat fluorescent lamp includes a front substrate, a back substrate having a continuous serpentine type discharge channel defined by a plurality of partitions, which are extended from both side ends of the back substrate and alternately disposed, a pair of electrodes provided on an outer surface of any one of the front substrate and the back substrate, and an inverter to apply power to the electrodes, wherein each of the electrodes includes a discharge electrode and a subsidiary electrode, in which the discharge electrodes are mounted in strip shapes along both side ends of the outer surface of the any one of the front substrate and the back substrate, and the subsidiary electrodes are mounted on the outer surface of the any one of the front substrate and the back substrate, and each of the subsidiary electrodes has a first subsidiary electrode disposed to be adjacent to any one of the discharge electrodes while being in parallel therewith, and a plurality of second subsidiary electrodes which are mounted to correspond to positions of the partitions, and are positioned to be perpendicular to the first subsidiary electrode, the second subsidiary electrodes of both the subsidiary electrodes being alternately connected to inner edges of both the first subsidiary electrodes so that neighboring electrodes have different polarities, and the discharge electrode and the first subsidiary electrode are separately connected to the inverter.

Any one of the discharge electrodes and the first subsidiary electrode adjacent to the any one of the discharge electrodes have the same polarities.

Each of the subsidiary electrodes, which are positioned to be perpendicular to the discharge electrodes, has a hollow part therein.

Further, a backlight unit using the flat fluorescent lamp according to the first embodiment of the present invention includes a diffusion member, a flat fluorescent lamp, which includes a front substrate, a back substrate having a continuous serpentine type discharge channel defined by a plurality of partitions, which are extended from both side ends of the back substrate and alternately disposed, a pair of electrodes provided on an outer surface of any one of the front substrate and the back substrate, and an inverter to apply power to the electrodes, and a frame having the diffusion member and the flat fluorescent lamp therein, wherein each of the electrodes includes a discharge electrode and a plurality of subsidiary electrodes, in which the discharge electrodes are mounted in strip shapes along both side ends of the outer surface of the any one of the front substrate and the back substrate, and the plurality of subsidiary electrodes are mounted on the outer surface of the any one of the front substrate and the back substrate to correspond to positions of the partitions, and are disposed to be perpendicular to the discharge electrodes, the plurality of subsidiary electrodes being alternately connected to inner edges of both the discharge electrodes so that neighboring subsidiary electrodes have different polarities.

Furthermore, a backlight unit using the flat fluorescent lamp according to the second embodiment of the present invention includes a diffusion member, a flat fluorescent lamp, which has a front substrate, a back substrate having a continuous serpentine type discharge channel defined by a plurality of partitions, which are extended from both side ends of the back substrate and alternately disposed, a pair of electrodes provided on an outer surface of any one of the front substrate and the back substrate, and an inverter to apply power to the electrodes, and a frame having the diffusion member and the flat fluorescent lamp therein, wherein each of the electrodes includes a discharge electrode and a subsidiary electrode, in which the discharge electrodes are mounted in strip shapes along both side ends of the outer surface of the any one of the front substrate and the back substrate, and the subsidiary electrodes are mounted on the outer surface of the any one of the front substrate and the back substrate, and each of the subsidiary electrodes has a first subsidiary electrode disposed to be adjacent to any one of the discharge electrodes while being in parallel therewith, and a plurality of second subsidiary electrodes which are mounted to correspond to positions of the partitions, and are positioned to be perpendicular to the first subsidiary electrode, and the second subsidiary electrodes of both the subsidiary electrodes being alternately connected to inner edges of both the first subsidiary electrodes so that neighboring electrodes have different polarities, and the discharge electrode and the first subsidiary electrode are separately connected to the inverter.

As such, any one of the discharge electrodes and the first subsidiary electrode adjacent to the any one of the discharge electrodes have the same polarities.

In addition, each of the subsidiary electrodes, which are positioned to be perpendicular to the discharge electrodes, has a hollow part therein.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a detailed description will be given of the present invention with reference to the appended drawings.

Figure 1:
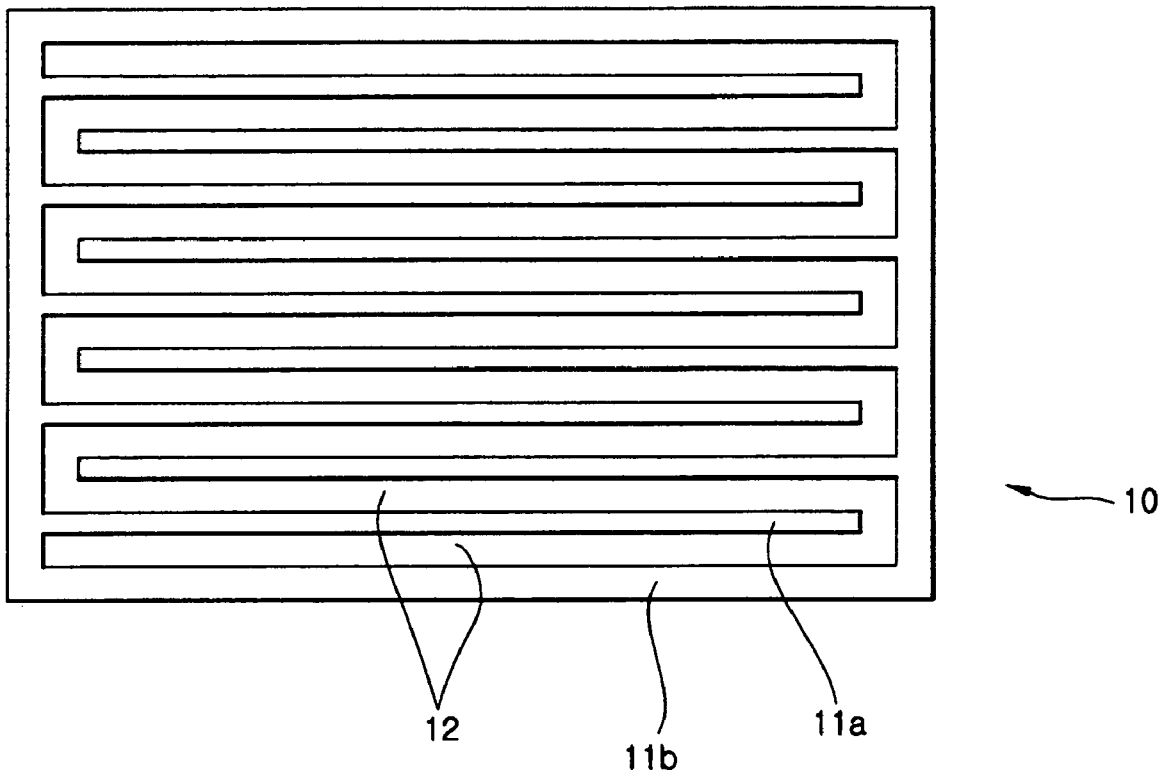
FIG. 1 is a top plan view of a substrate having a serpentine type discharge channel.

FIG. 1 is a top plan view of a substrate having a serpentine type discharge channel.

As shown in FIG. 1, a plurality of partitions 11*a* and 11*b*, which are extended from both side ends of a substrate 10 and alternately disposed, define a space, so that the space acts to form a discharge channel 12 having a continuous serpentine shape in the substrate 10. In this case, the substrate 10 may be any one of a front substrate and a back substrate constituting two flat glass plates in a flat fluorescent lamp.

That is, the discharge channel 12 formed between the front substrate and the back substrate has a continuous serpentine shape, so as to increase a vacuum exhaustion rate of the flat fluorescent lamp, while obtaining an effective mercury diffusion.

Further, turning points of the discharge channel 12 have preferably widths not more than 5 mm. This is because the extremely wide discharge channel 12 at the turning points result in an unstable discharge.

Also, with the aim of generating a uniform and stable discharge, the discharge channel 12 is 5–15 mm wide and 2–5 mm high. In such cases, if the discharge channel 12 has too small a sectional area, a driving voltage increases, and thus, the discharge becomes unstable. Meanwhile, if the discharge channel 12 has too large a sectional area, although the driving voltage decreases, a plasma discharge occurs not through the overall discharge channel but through a part of the discharge channel. Thereby, luminescence of a fluorescent material does not uniformly occur in the overall discharge channel 12, resulting in localized dark regions.

Moreover, it is preferred that the partitions 11*a* and 11*b*, acting to define the continuous serpentine type discharge channel 12, have top surfaces of widths amounting to ones of mm or less, so as to decrease non-luminescent regions.

To form the discharge channel 12 on the substrate 10, there are proposed various methods, for example, a sand blast process, a laser process, a grinding process, and a shaping process of a heated substrate by means of press or vacuum suction. In addition, to form the discharge channel 12 on the substrate 10, a flat glass plate may be cut to a height of the partition, coated with a sealing frit, and then thermally attached to the front substrate or the back substrate. The proper process is selected from among the above listed examples, according to the preparation method of the front and back substrates.

For uniform luminescence of the flat fluorescent lamp having the serpentine type discharge channel, an electrode structure mounted to the flat fluorescent lamp acts as a very important factor. That is, a discharge initiating voltage decreases to induce a uniform and stable discharge, thereby increasing the possibility of uniform luminescence of the flat fluorescent lamp.

Hence, to decrease the discharge initiating voltage, there may used a short spacing between electrodes, or a lower pressure of a discharge gas. In the present invention, the process of shortening the electrode spacing is adopted. That is, to shorten the electrode spacing under the same size condition of the flat fluorescent lamp, the width of the strip-shaped discharge electrode increases, whereby the spacing between the discharge electrodes may decrease. However, a large width of the discharge electrode may lead to an increase of the undesired non-luminescent regions, and hence, limitations are imposed on the above process. Accordingly, in the present invention, while the width of the strip-shaped discharge electrode is suitably maintained, subsidiary electrodes that serve to drastically reduce the electrode spacing are additionally mounted between the discharge electrodes, thus lowering the discharge initiating voltage.

Figure 2:
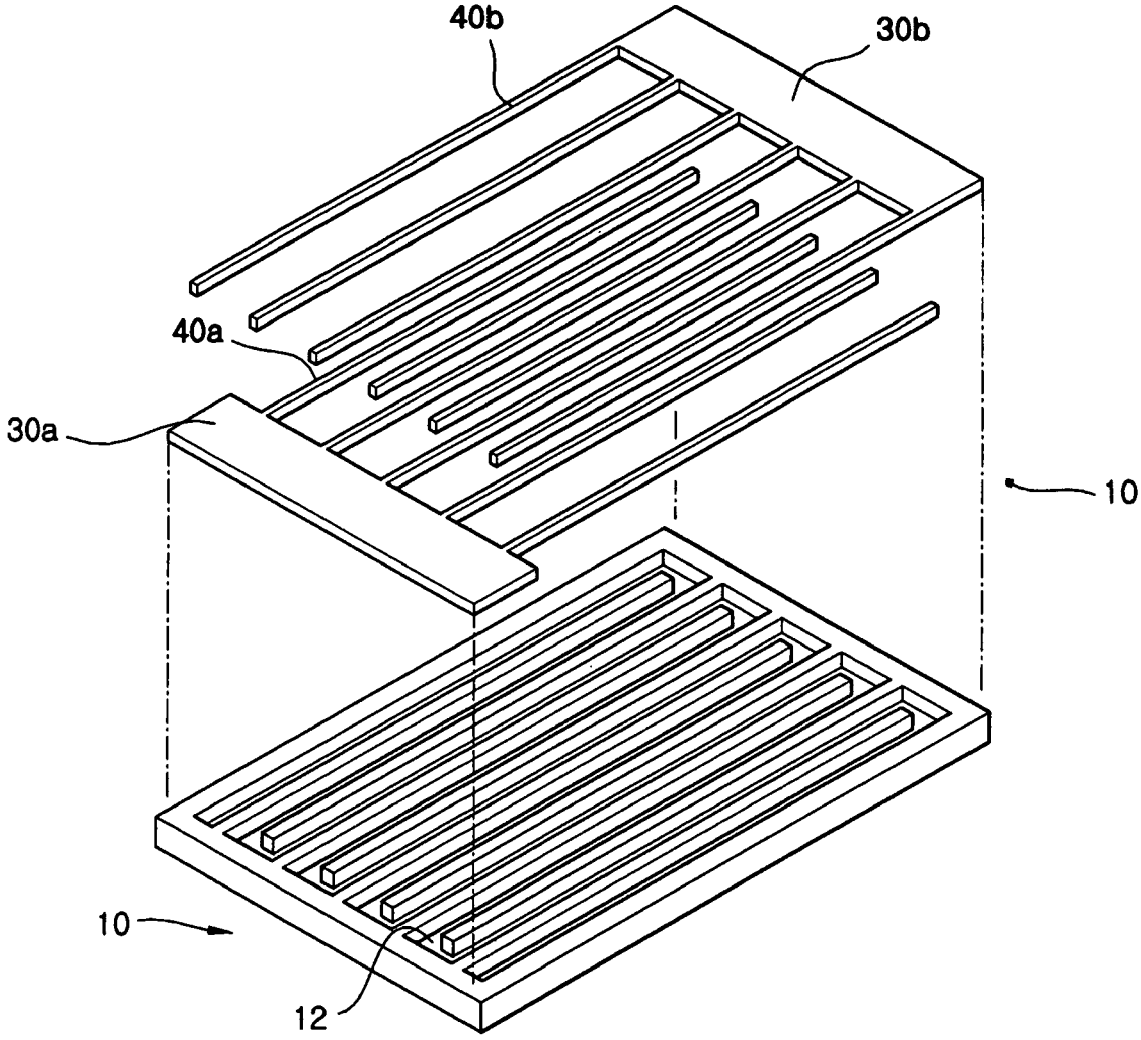
FIG. 2 is an exploded perspective view of an electrode structure provided on a substrate having a serpentine type discharge channel, in a flat fluorescent lamp according to a first embodiment of the present invention.
Figure 3:
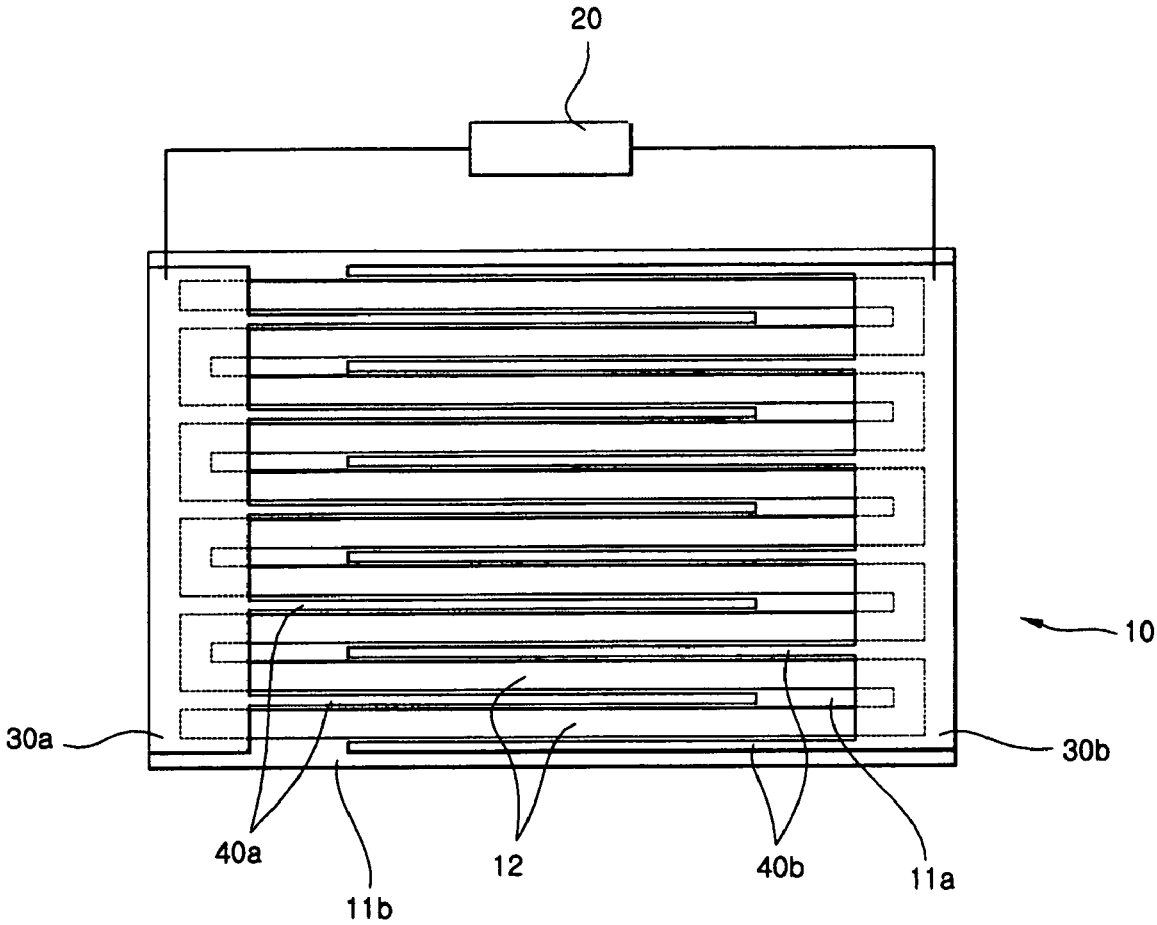
FIG. 3 is a schematic view of the electrode structure provided on the substrate having a serpentine type discharge channel, in the flat fluorescent lamp of according to the first embodiment of the present invention.

FIGS. 2 and 3 are an exploded perspective view and a schematic view of an electrode structure that is provided to a substrate to have a serpentine type discharge channel, according to a first embodiment of the present invention.

As shown in the above drawings, the flat fluorescent lamp, according to the first embodiment of the present invention, includes a strip-shaped discharge electrode 30*a* disposed on a first side end of a back substrate 10 having a discharge channel 12 defined by a plurality of partitions 11*a* and 11*b*, and a plurality of subsidiary electrodes 40*a* disposed to correspond to positions of upper surfaces of the even number of partitions 11*a* and integrally connected to an inner edge of the discharge electrode 30*a*. Further, a strip-shaped discharge electrode 30*b* is provided on a second side end of the back substrate 10, and a plurality of subsidiary electrodes 40*b* are disposed to correspond to positions of upper surfaces of the odd number of partitions 11*b*, and are integrally connected to an inner edge of the discharge electrode 30*b*.

As such, each of the strip-shaped discharge electrodes has a width ranging from 10 to 40 mm. When the width of the discharge electrode is less than 10 mm, a discharge current does not sufficiently flow between the discharge electrodes, and hence, the discharge mainly occurs between the subsidiary electrodes, whereby the discharge becomes very unstable. Eventually, the flat fluorescent lamp has a low luminance, and thus, is difficult to be applied for a backlight unit.

Meanwhile, if the width of the discharge electrode exceeds 40 mm, the discharge may stably occur. However, the non-luminescent regions of the flat fluorescent lamp, that is, a marginal area of the backlight unit, becomes large, thus decreasing marketability. Therefore, it is preferable that the width of the strip-shaped discharge electrode should be in the range of 10–40 mm.

Further, since all the subsidiary electrodes 40*a* and 40*b* mounted on the partitions 11*a* and 11*b* have widths equal to or narrower than those of the partitions 11*a* and 11*b*, the spacing between the subsidiary electrodes 40*a* and 40*b* is short to the extent of that between the partitions 11*a* and the partitions 11*b*. Preferably, the spacing between the subsidiary electrodes 40*a* and 40*b* ranges from 5 to 15 mm.

In such cases, the reason why the widths of the subsidiary electrodes 40*a* and 40*b* are limited to those of the partitions 11*a* and 11*b* is that the use of the subsidiary electrodes 40*a* and 40*b* having enormous widths results in a high power consumption due to increase of the discharge current in the subsidiary electrodes 40*a* and 40*b*. In addition, visible light which is emitted out of the front substrate (not shown) is blocked, thus decreasing the luminance of the flat fluorescent lamp.

Upon application of weak power from an inverter 20, which is connected to the discharge electrodes 30*a* and 30*b* of the flat fluorescent lamp having the above electrode structure by means of a lead wire, a preparative discharge or a subsidiary discharge occurs in the discharge channel 12 by the subsidiary electrodes 40*a* and 40*b* alternately connected to both the discharge electrodes 30*a* and 30*b*. Thereby, either an ion or an electron is formed. Accordingly, a desired discharge easily occurs between the discharge electrodes 30*a* and 30*b* by the previously-formed ion or electric charge. Hence, the use of the strip-shaped discharge electrodes 30*a* and 30*b* having small widths results in that the discharge between the discharge electrodes is easily induced by the subsidiary electrodes while minimizing the non-luminescent regions. Consequently, the discharge can be initiated even at a low discharge initiating voltage, resulting in saving power.

Further, since the preparative discharge or subsidiary discharge generated by the subsidiary electrodes 40*a* and 40*b* uniformly occur in the overall discharge channel 12 having the serpentine shape, the discharge generated by the strip-shaped discharge electrodes 30*a* and 30*b* uniformly occurs in the overall discharge channel 12 having the serpentine shape. Thereby, an optimal luminance uniformity is maintained, and thus, the flat fluorescent lamp has a uniform screen brightness.

On the other hand, the discharge electrodes 30*a* and 30*b* and the subsidiary electrodes 40*a* and 40*b* may be positioned at the lower surface of the back substrate 10 as well as the upper surface thereof. In the cases of being positioned at the lower surface of the back substrate 10, the subsidiary electrodes 40*a* and 40*b* are positioned at locations of the lower surface of the back substrate 10 corresponding to the partitions 11*a* and 11*b*. Further, a fluorescent layer (not shown) is coated on the discharge channel 12.

Figure 4:
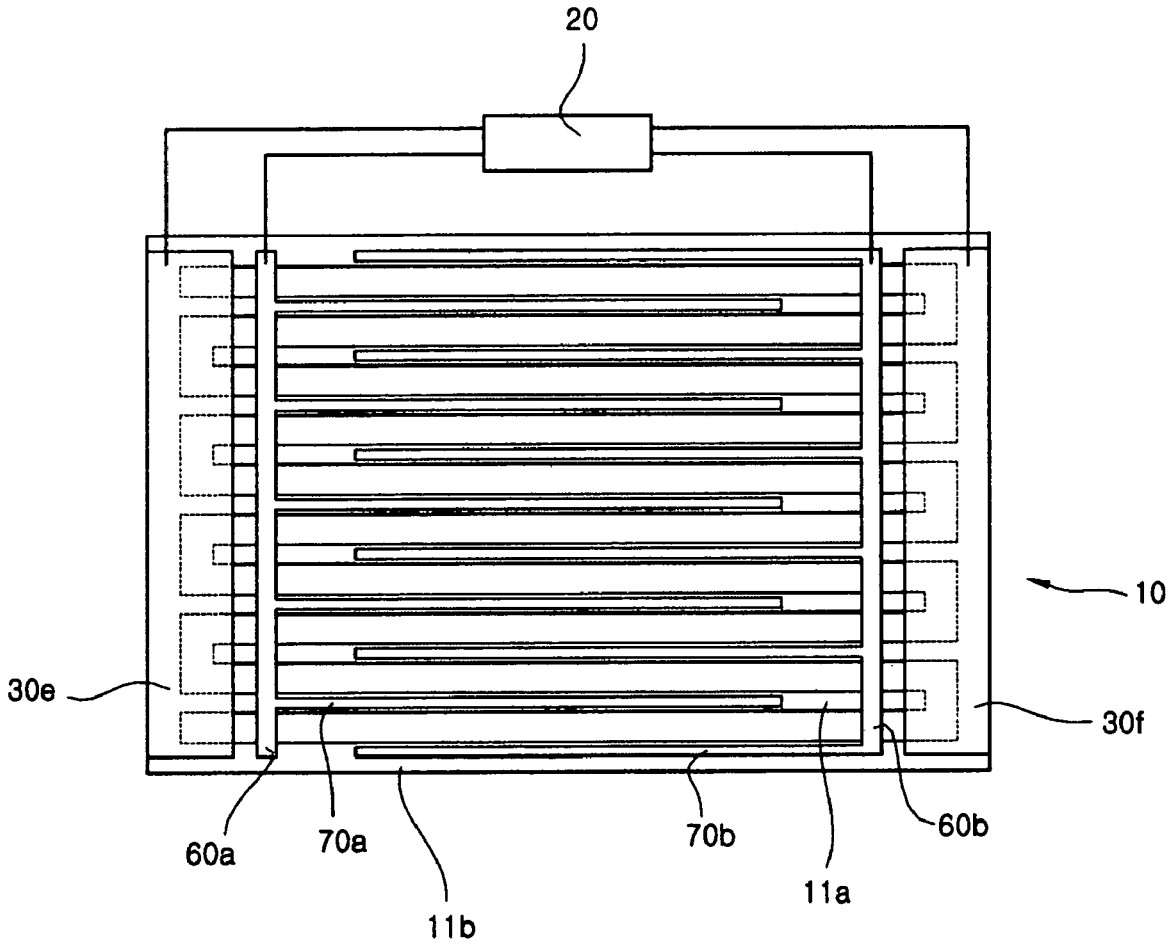
FIG. 4 is a schematic view of an electrode structure provided on a substrate having a serpentine type discharge channel, in a flat fluorescent lamp according to a second embodiment of the present invention.

FIG. 4 shows an electrode structure of a flat fluorescent lamp, according to a second embodiment of the present invention. The flat fluorescent lamp, according to the second embodiment, includes discharge electrodes 30*e* and 30*f*, and a pair of first subsidiary electrodes 60*a* and 60*b* positioned to be adjacent to the discharge electrodes 30*e* and 30*f* while being in parallel therewith. In addition, a plurality of second subsidiary electrodes 70*a* and 70*b* are integrally connected to the first subsidiary electrodes 60*a* and 60*b* to correspond to positions of upper surfaces of the partitions 11*a* and 11*b* and to be perpendicular to the first subsidiary electrodes 60*a* and 60*b*. As such, the discharge electrodes 30*e* and 30*f* and the first subsidiary electrodes 60*a* and 60*b* are connected to an inverter 20 to be separately fed with power.

As for the above flat fluorescent lamp, power is intermittently applied to the first subsidiary electrodes 60*a* and 60*b*, or power of low strength is applied thereto, whereby the use of the power is efficiently controlled. Thus, such a flat fluorescent lamp is advantageous in terms of simple and economical fabrication. Like this, when the power is separately applied to the discharge electrodes 30*e* and 30*f* and the first subsidiary electrodes 60*a* and 60*b*, it is preferred that the visible light is prevented from blocking by using the first subsidiary electrodes 60*a* and 60*b* having minimized widths.

Figure 5:
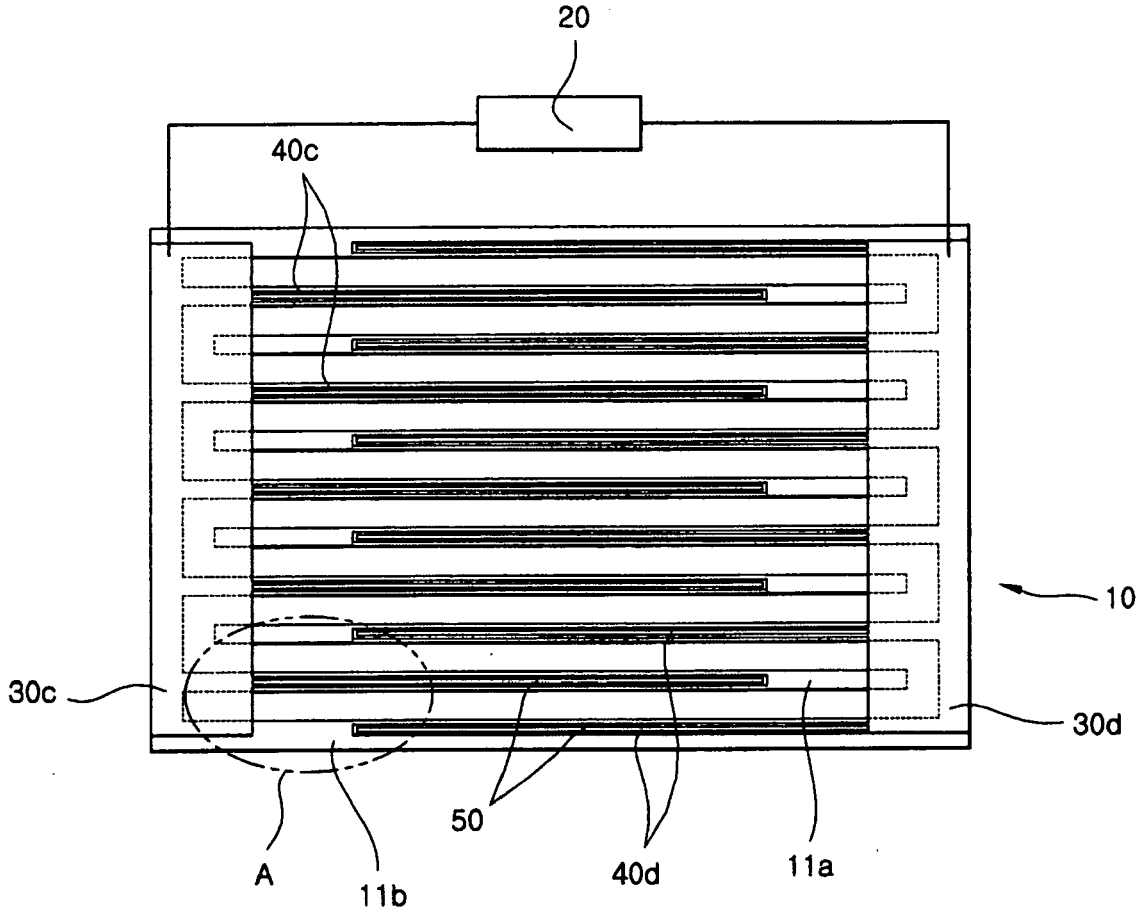
FIG. 5 is a schematic view of an electrode structure provided on a substrate having a serpentine type discharge channel, in a flat fluorescent lamp according to a third embodiment of the present invention.
Figure 6:
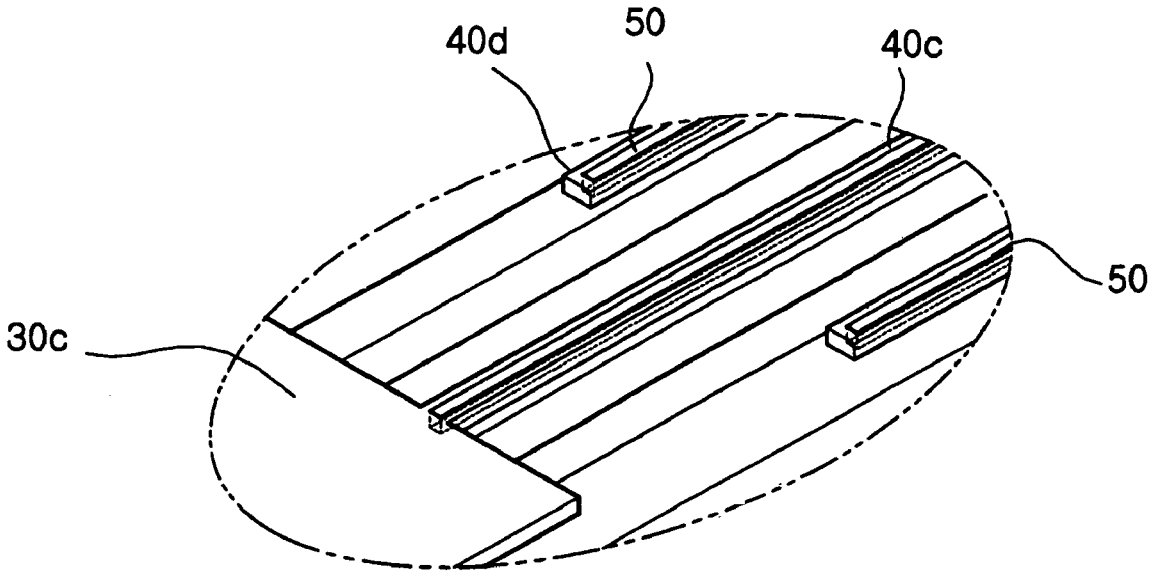
FIG. 6 is an enlarged perspective view of an "A" portion of FIG. 5.

FIGS. 5 and 6 illustrate an electrode structure of a flat fluorescent lamp according to a third embodiment of the present invention, which is the similar to that of the first embodiment. That is, on a first side end of a back substrate 10 having a discharge channel 12 defined by partitions 11*a* and 11*b*, there are provided a strip-shaped discharge electrode 30*c*, and a plurality of subsidiary electrodes 40*c* disposed to correspond to positions of upper surfaces of the even number of partitions 11*a* and integrally connected to an inner edge of the discharge electrode 30*c*. Further, on a second side end of the back substrate 10, there are provided a strip-shaped discharge electrode 30*d*, and a plurality of subsidiary electrodes 40*d* disposed to correspond to positions of upper surfaces of the odd number of partitions 11*b* and integrally connected to an inner edge of the discharge electrode 30*d*.

In addition, hollow parts 50 are formed in the subsidiary electrodes 40*c* and 40*d* respectively, thereby saving power. The structure having the hollow parts 50 in the subsidiary electrodes 40*c* and 40*d* may be applied to the second subsidiary electrodes 70*a* and 70*b* of the second embodiment.

The strip-shaped discharge electrode is connected to an output terminal of the inverter to be fed with the power. In such cases, when a high power consumption is required due to the larger area of the flat fluorescent lamp, the capacity of the inverter is increased, thereby increasing the size of the inverter.

Moreover, the flat fluorescent lamp of the present invention is mounted to the backlight unit. As such, a high power consumption is required, and thus, the size of the inverter, in particular, the height thereof, increases, which causes the increase of the thickness of the backlight unit. Hence, to decrease the thickness of the backlight unit, two inverters may be employed. For this, the strip-shaped discharge electrode may be divided into two.

As described hereinbefore, the present invention provides a flat fluorescent lamp and a backlight unit using the same. In the present invention, a width of a strip-shaped discharge electrode decreases, whereby a discharge between the discharge electrodes is easily induced by subsidiary electrodes while minimizing a non-luminescent region. Thus, the discharge occurs even at a low driving voltage (discharge initiating voltage). In addition, thanks to an optimally maintained luminance uniformity, the flat fluorescent lamp has a uniform screen brightness.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A flat fluorescent lamp, comprising:

a front substrate;

a back substrate having a continuous serpentine type discharge channel defined by a plurality of partitions, which are extended from both side ends of the back substrate and alternately disposed;

a pair of electrodes provided on an outer surface of any one of the front substrate and the back substrate; and an inverter to apply power to the electrodes, wherein each of the electrodes includes a discharge electrode and a plurality of subsidiary electrodes, each of the subsidiary electrodes being perpendicular to the discharge electrode and having a hollow part therein;

the discharge electrodes are mounted in strip shapes along both side ends of the outer surface of the any one of the front substrate and the back substrate, and the plurality of subsidiary electrodes are mounted on the outer surface of the any one of the front substrate and the back substrate, the plurality of subsidiary electrodes being aligned with the partitions in directly overlying relation to the partitions, and the subsidiary electrodes being disposed perpendicular to the discharge electrodes, the plurality of subsidiary electrodes being alternately connected to inner edges of both the discharge electrodes so that neighboring subsidiary electrodes have different polarities;

wherein crosstalk between parallel portions of the discharge channel is inhibited.

2. A flat fluorescent lamp, comprising:

a front substrate;

a back substrate having a continuous serpentine type discharge channel defined by a plurality of partitions, which are extended from both side ends of the back substrate and alternately disposed;

a pair of electrodes provided on an outer surface of any one of the front substrate and the back substrate; and an inverter to apply power to the electrodes, wherein each of the electrodes includes a discharge electrode and a subsidiary electrode, the discharge electrodes are mounted in strip shapes along both side ends of the outer surface of the any one of the front substrate and the back substrate, the subsidiary electrodes are mounted on the outer surface of the any one of the front substrate and the back substrate, and each of the subsidiary electrodes has a first subsidiary electrode that is not in physical contact with any one of the discharge electrodes, the first subsidiary electrode extending parallel to at least one of the discharge electrodes; and a plurality of second subsidiary electrodes defining a contour, the contour being aligned with the partitions, and the second subsidiary electrodes being perpendicular to the first subsidiary electrode, the second subsidiary electrodes of both the subsidiary electrodes being alternately connected to inner edges of both the first subsidiary electrodes so that neighboring electrodes have different polarities, and the discharge electrode and the first subsidiary electrode are separately connected to the inverter.

3. The flat fluorescent lamp as defined in claim 2, wherein any one of the discharge electrodes and the first subsidiary electrode adjacent to the any one of the discharge electrodes have the same polarities.

4. The flat fluorescent lamp as defined in claim 2, wherein each of the subsidiary electrodes, which are positioned to be perpendicular to the discharge electrodes, has a hollow part therein.

5. A backlight unit, comprising:

a flat fluorescent lamp, which includes a front substrate, a back substrate having a continuous serpentine type discharge channel defined by a plurality of partitions, which are extended from both side ends of the back substrate and alternately disposed, a pair of electrodes provided on an outer surface of any one of the front substrate and the back substrate, and an inverter to apply power to the electrodes; and a frame having the flat fluorescent lamp therein, wherein each of the electrodes includes a discharge electrode and a plurality of subsidiary electrodes, each of the subsidiary electrodes being perpendicular to the discharge electrodes and having a hollow part therein;

the discharge electrodes are mounted in strip shapes along both side ends of the outer surface of the any one of the front substrate and the back substrate, the plurality of subsidiary electrodes are mounted on the outer surface of the any one of the front substrate and the back substrate in positions that directly overlie the partitions, and are disposed to be perpendicular to the discharge electrodes, the plurality of subsidiary electrodes being alternately connected to inner edges of both the discharge electrodes so that neighboring subsidiary electrodes have different polarities;

wherein crosstalk between parallel portions of the discharge channel is inhibited.

6. A backlight unit, comprising:

a flat fluorescent lamp, which includes a front substrate, a back substrate having a continuous serpentine type discharge channel defined by a plurality of partitions, which are extended from both side ends of the back substrate and alternately disposed, a pair of electrodes provided on an outer surface of any one of the front substrate and the back substrate, and an inverter to apply power to the electrodes; and a frame having the flat fluorescent lamp therein, wherein each of the electrodes includes a discharge electrode and a subsidiary electrode, the discharge electrodes are mounted in strip shapes along both side ends of the outer surface of the any one of the front substrate and the back substrate, the subsidiary electrodes are mounted on the outer surface of the any one of the front substrate and the back substrate, and each of the subsidiary electrodes has a first subsidiary electrode disposed at a predetermined spacing from an adjacent one of the discharge electrodes while being in parallel therewith; and a plurality of second subsidiary electrodes which are mounted in positions that are aligned with the partitions, the second subsidiary electrodes being in positions perpendicular to the first subsidiary electrode, and the second subsidiary electrodes of both the subsidiary electrodes being alternately connected to inner edges of both the first subsidiary electrodes so that neighboring electrodes have different polarities, and the discharge electrode and the first subsidiary electrode are separately connected to the inverter.

7. The backlight unit as defined in claim 6, wherein any one of the discharge electrodes and the first subsidiary electrode adjacent to the any one of the discharge electrodes have the same polarities.

8. The backlight unit as defined in claim 6, wherein each of the subsidiary electrodes, which are positioned to be perpendicular to the discharge electrodes, has a hollow part therein.

* * * * *